United States Patent [19]

Pardini et al.

[11] Patent Number: 5,055,643

[45] Date of Patent: Oct. 8, 1991

[54] TRIPPING EMERGENCY PUSH-BUTTON

[75] Inventors: Franco Pardini, Milan; Falchi Fiorino, Sangano, both of Italy

[73] Assignee: CGE Compagnia Generale Elettromeccanica SPA, Milan, Italy

[21] Appl. No.: 488,642

[22] Filed: Mar. 5, 1990

[30] Foreign Application Priority Data

Mar. 9, 1989 [IT] Italy ..... 19707 A/89

[51] Int. Cl.[5] ..... H01H 3/20

[52] U.S. Cl. ..... 200/318.2; 200/43.08; 200/341; 200/302.2; 200/529; 74/2; 74/110; 74/99 A

[58] Field of Search ..... 200/341, 345, 302.2, 200/318.2, 321, 520, 533, 502, 43.08, 528, 568, 570, 566; 52/110, 2, 527, 99 A

[56] References Cited

U.S. PATENT DOCUMENTS

| | | | |
|---|---|---|---|
| 4,181,826 | 1/1980 | Latasiewicz | 200/314 |
| 4,431,881 | 2/1984 | Sauer et al. | 200/318.2 |

FOREIGN PATENT DOCUMENTS

| | | | |
|---|---|---|---|
| 1128508 | 4/1962 | Fed. Rep. of Germany | 200/318.2 |
| 1929364 | 6/1970 | Fed. Rep. of Germany | 200/341 |
| 2263762 | 4/1974 | Fed. Rep. of Germany | 200/328 |
| 1180999 | 9/1985 | U.S.S.R. | 200/318.2 |
| 2169142 | 7/1986 | United Kingdom | 200/341 |

*Primary Examiner*—Henry J. Recla
*Assistant Examiner*—Glenn T. Barrett
*Attorney, Agent, or Firm*—Helfgott & Karas

[57] ABSTRACT

An emergency push-button comprises a housing and a support rigidly connected to a movable actuation knob and axially movable therewith. The support acts on a releasing mechanism, operated by rotation of the knob about an axis parallel to the movement direction of the movable slider. The button further includes an axially movable member provided with at least one retaining tooth, which, upon lowering of the movable knob, rotates about an axis parallel to the moving direction of the knob, compelling the retaining tooth to release at least one protrusion provided on the housing and, once the movable member has cleared through a tripping action, it also rotates in a tripping manner carrying the retaining tooth to the position under the protrusion, preventing the movable member from moving back to a raised position thereof. The release of the retaining tooth may be obtained just through a rotating movement of the knob in a reversed direction with respect to the retaining movement. A cylinder lock may be provided within a knob.

13 Claims, 3 Drawing Sheets

10 Fig.1a
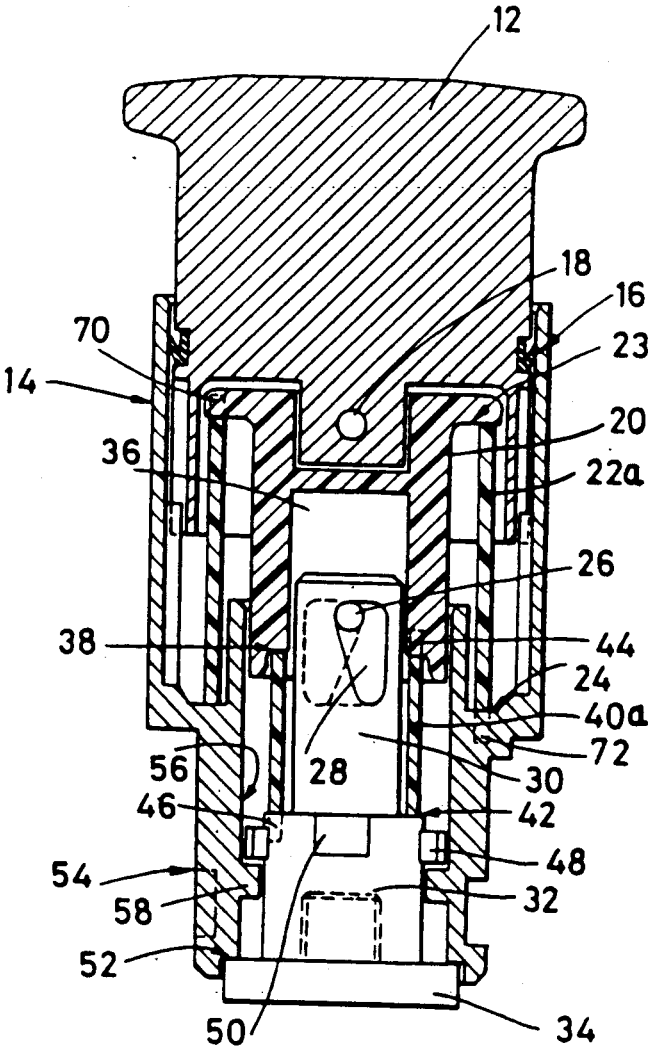

TRIPPING EMERGENCY PUSH-BUTTON

The present invention relates to an emergency push-button having safe and non equivocal actuation, obtained through tripping, of the kind used for providing safety interventions on electrical, electromechanical or electronic devices or plants in order to obviate problems or to intervene the fastest the possible in emergency situations. Such a kind of emergency push-buttons are largely used for example, but not exlusively, on carrying or lifting devices, such as conveying belts, elevators, cranes, escalators and lifts, or in monitoring and alert plants against accidents, such as fires, blastings, floods, or crimes, such as stealings, hooliganisms, damages or the like.

There are already many emergency push-buttons and one of the objects sought to be obtained therethrough is a safe actuation, i.e. the safety that, once they are actuated, not only they interrupt their action or are deactuated, but they can be deactuated only at will by an explicit deactuating action. Further, said emergency push-buttons, must operate switches actuated by them even in case of failures of their components or damages to the contacts, such as light welding thereof.

All the emergency push-buttons, to meet the safety international regulations, are provided with a large knob or slider, having mushroom shape, which is actuable by a hand palm to permit the fastest and the safest the possible intervention.

A known kind of emergency push-button is provided on a stem of the mushroom knob with a permanent magnet secured thereto which, upon being depressed by action on the knob, is coupled to another permanent magnet strictly connected to fixed structures of the same emergency push-button and inversly biased with respect to the first magnet, so that the magnets sharply attract each other, when their reciprocal distance falls under a preset level, providing the knob collapse without any actuation unsafety.

In this case the actuation is very safe, but there is, however, a problem of a very difficult push-button deactuation if the two permanent magnets come too near each other, owing to the very high forces required to disconnect them.

It is possible to try to reduce said force to a reasonable level by interposing a non magnetic material gap, having calibrated thickness, but in any event squeezing, detaching or somehow thinning such a gap can result again in exaggerated attractive forces between the magnets, making void all the advantages coming from said non magnetic gap.

Another known kind of emergency push-button is a snap action push-button having on a stem of the mushroom knob two conical enlargements having faced bases separated by a circumferential groove of a semicircular cross-section to house latches or engaging means, such as balls, provided around the stem and pushed by springs acting perpedicularly to the axis of the stem and arranged in seats dug in a fixed housing of the push-button, said latches or balls acting as latching means to mantain the emergency push-button in actuated position when an actuation has been carried out thereon. This second system is however more unsafe than the first one, because it is sufficient that the knob actuation be a little weaker than necessary for having the knob coming back in the deactuated position as the latches or balls were not able to go over the tripping point in moving from the conical surface to the circumferential groove. Further, wear in the edges of the groove makes actuation more and more unsafe, eventually significantly lowering the reliability of the push-button.

SUMMARY OF THE INVENTION

An object of the present invention is to provide an emergency push-button having active contact opening preserving switching features in time in spite of possible wear of components without having difficult recovery or unsafe actuation.

A further object is to provide through a suitable overstroke of movable components of the push-button an active actuation of controlled contacts even in the case of faults of push-button components or contact damages, such as a light welding.

It is to realize that the prior art emergency push-buttons hereabove considered are all of the direct action and latching kind, in which a force applied to contact means, such as microswitches or the like, directly depends on the force normally applied to their knobs.

On the contrary, an emergency tripping push-button would be suitable in which the energy providing actuating contacts is properly stored in spring means remaining always the same and providing a constant actuating power.

The above object is attained by an emergency push-button according to the invention having latching means and means for tripping an axially movable slider for the button provided with a movable member by a stroke and rotation around an axis parallel to the actuation direction of said slider, characterized in that at least a retaining area on the movable member is engaged through going over and subsequent abutting obtained by means of a tripping mechanism under at least one detent member facing the retaining area, said retaining area being unlatcheable from said detent member through subsequent rotation overcoming the same.

The member movable through an axial stroke and rotation, is provided with more than one retaining area, going over and subsequently engaging more than one corresponding detent members on the fixed structure of the push-button.

The rotation together with the translation movement of said movable member is obtained through the action of a cam assembly between said slider and said movable member.

More preferably, said cam assembly is comprised of a first pin member integral with said axially movable slider and a cavity provided with at least two shaped surfaces of which one is arranged parallel to the movement axis of the movable slider and the other is sloping with respect to the movement axis.

Alternatively the cavity is provided with two shaped surface pairs of which a first pair is arranged parallel to the movement axis of the movable slider and a second pair is slanting with respect to said movement at axis, providing said slanting surface the rotary movement of said movable member.

Still more preferable, said movable member is connected to said slider through resilient means changeable by strain in a first direction parallel to the axis of said slider and in a second direction perpendicular to said slider axis to allow a first rotary movement of said movable member, in order to have a retaining tooth of said movable member snapping or tripping over a detent, an axial advancing movement over said detent and a second rotary movement in a reversed direction with respect to the first one to engage said retaining tooth of said movable member with said detent.

Particularly, said resilient means are comprised of a first axially strainable spring which is charged by compression and then is discharged to allow the advancing of said movable member with respect to said detent, and a second spring which is charged to have a retaining tooth of said movable member to move over said detent and then is discharged to get said retaining tooth under said detent. More particularly, said resilient means are comprised of just one spring, which is axially compressive and rotary by torsion in order to allow said retaining tooth to get over said detent to axially advance beyond it and to come back under said detent.

Alternatively said resilient means are comprised of an elastomeric sleeve strainable both by compression and rotation in order to have said retaining tooth to move over the detent member axially advancing and coming back under the detent member. The detent members may be formed by protrusions provided on the housing.

In addition, the emergency push-button according to the present invention is provided with a cam assembly having an axial length smaller than the stroke allowed to said movable slider so that in case of breaking of said resilient means, such as the spring of said movable member, a deeper stroke of said movable member is provided to push forward said movable member, providing in any case the movement thereof. Further, if a planar disk under said movable member is prevented from the movement by damages, such as a partial welding of controlled contact means, the overstroke could help the push of the resilient means, adding some force for overcoming said protrusion.

The emergency push-button according to the present invention further includes resilient means under a knob of said slider, which are axially compressed at the time of the actuation and remain charged after said slider has been retained by said movable member in turn retained by the retaining teeth thereof under said protrusions. The resilient means may be further actuated by rotation of the knob in order to cause the tripping of the retaining teeth from said protrusions and effect coming back of the knob to a recovered position.

Particularly, the resilient means under the sliding knob comprise of a pair of springs of which a first is axially acting and the second is rotary acting.

Preferably, said resilient means are comprised of just one spring strainable by axial compression at the actuation time of the emergency push-button, remaining charged by the engagement of the teeth under said protrusions and subsequently strainable by torsion owing to a rotation of the knob to disengage the retaining teeth from said protrusions.

Alternatively, to cause the recovery of said emergency push-button it is possible to provide, instead of a rotation actuable knob, a cylinder lock, actuable by a key, within a non-turnable knob.

Alternatively, instead of the spring resilient means, it is possible to provide an elastomeric sleeve strainable both by axial compression and by torsion.

The features and advantages of the present invention will be more apparent from the following detailed description of some embodiment thereof, not to be considered in limiting sense, provided with the enclosed drawings.

BRIEF DESCRIPTION OF THE DRAWINGS

FIG. 1A is a side view in section of another embodiment of the invention, differing from the first embodiment by an elastomeric sleeve;

DETAILED DESCRIPTION OF THE PREFERRED EMBODIMENTS

Figure 1:
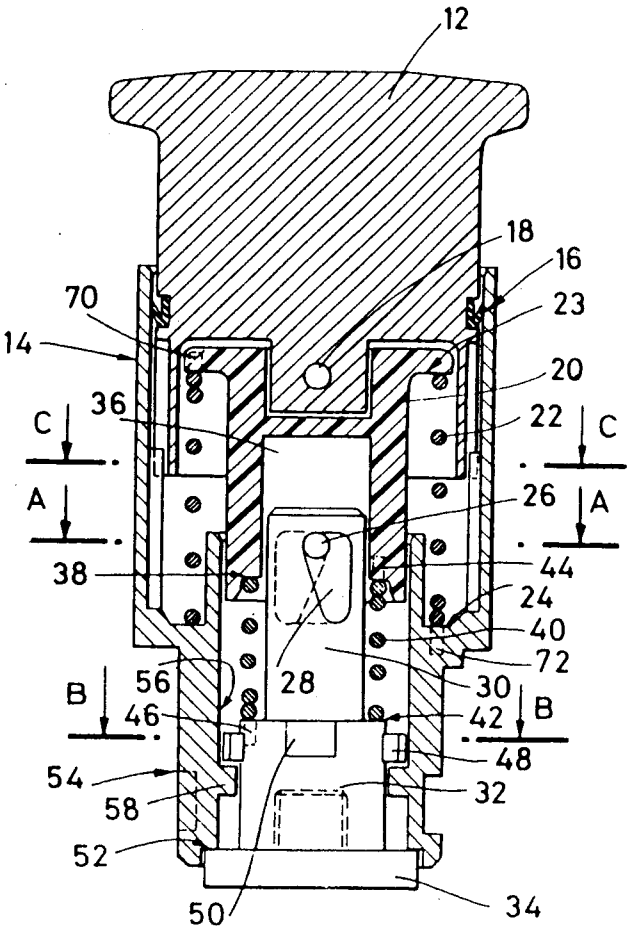
FIG. 1 is lateral view in cross section of a first embodiment of the invention.
Figure 3:
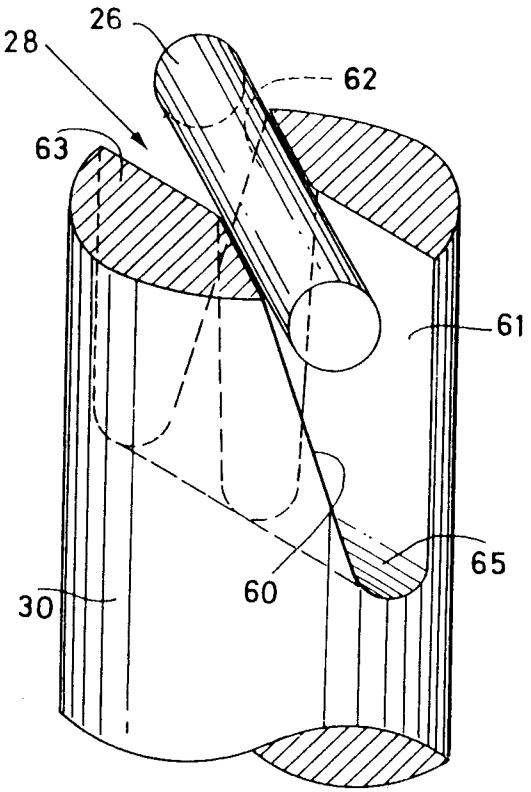
FIG. 3 is a perspective, partially broken away view of a cam mechanism used in both embodiments.
Figure 5:
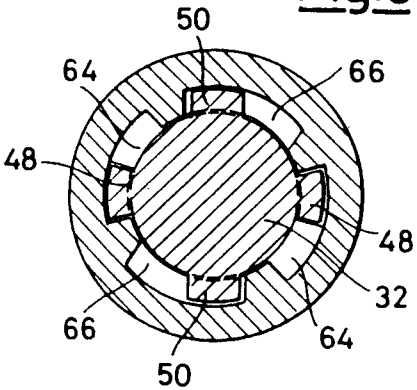
FIG. 5 is a cross-section view along line B—B of either FIG. 1 or FIG. 2.

Referring now to FIGS. 1 and 3, depicting a first embodiment, an emergency push-button 10 consists of a movable slider 12, having the shape of a mushroom knob, slidable in a substantially tubular housing 14 in which it is sealed by a seal 16. The mushroom knob 12 is connected through a pin 18 to a plastic support 20 spring held in an emitted position by a spring 22 abutting against a flange 23 of support 20 and against a seat 24, provided in the tubular housing 14, said spring having the duty to maintain the mushroom knob 12 in the emitted position.

Through the plastic support 20 passes a second pin 26 engaged in a cam assembly 28 formed within a stem 30 of a movable member 32 transmitting, through a planar disk pad 34, an axial movement to underlying contact means (not shown in FIG. 1). The above mentioned plastic support 20 is provided with a bore 36 housing the stem 30 of the movable member 32 and ends with a seat 38 housing a spring 40 abutting on a shoulder 42 of the underlying movable member 32, said spring 40 being further secured by a first pin 44 extending into a hole through the seat 38 and by a second pin 46 extending in a hole through the shoulder 42. The movable member 32 is provided with a plurality of small retaining teeth 48 and of stroke limiting teeth 50.

The planar disk pad 34 abuts eventually in the rest position against a seat 52 formed in the lower end 54 of the tubular housing 14.

The lower end 54 of the housing 14 is provided with an internal bore 56 from which extend protrusions 58 engageable with the retaining teeth 48.

Figure 4:
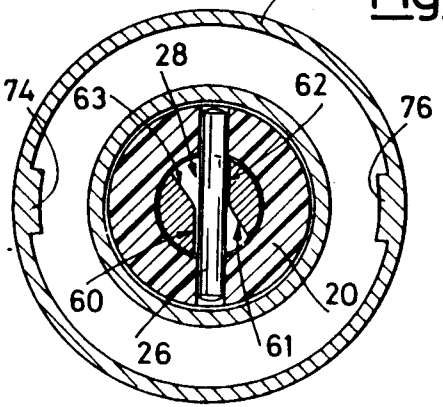
FIG. 4 is a cross-section view along line A—A of either FIG. 1 or FIG. 2.

Referring now particularly to FIGS. 3 and 4, the structure of the cam assembly 28 is better understood.

The cam assembly has a bore housing the pin 26 and crossing the stem 30, provided with two first opposing profiles 60 and 62 sloping with respect to the axis of the stem 30 and with two second opposing profiles 61 and 63 parallel to said axis and joining said two profiles 60 and 62 along a rounded corner 65.

Figure 2:
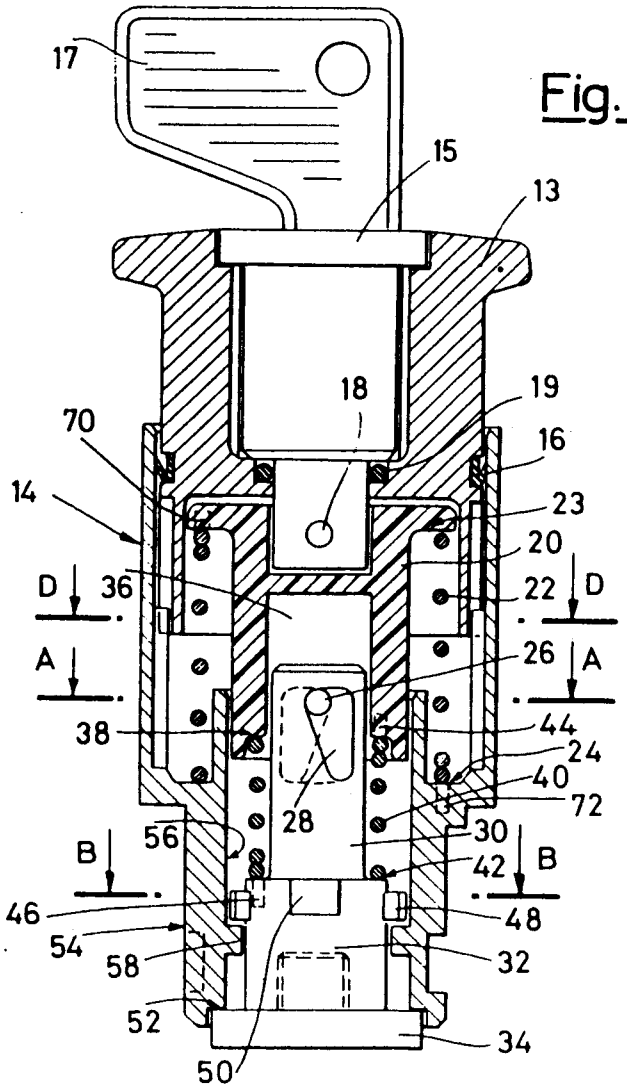
FIG. 2 is a side view in section of a second embodiment of the invention, differing from the first embodiment by a key recovery mechanism.

FIG. 2 depicts a second embodiment of the invention similar to the first one, except that instead of the mushroom knob 12 is used a mushroom knob 13, provided with a cylinder look 15 actuable to recover the position of the knob 13 by means of a key 17, connected to the support 20 through a pin 18 and provided with a seal 19, the remaining components of the second embodiment being substantially similar to those of the first embodiment.

To understand the operation of the invention in the two embodiments, reference is made to FIGS. 1 to 5.

When either the mushroom knob 12 or the mushroom knob 13 is depressed, the plastic support 20 is depressed too, trailing the pin 26 in axial downwards movement. The pin 26 acts against the two sloping opposed profiles 60 and 62 of the cam assembly 28, causing the rotation of the stem 30 connected to the movable member 32, compelling the spring 40, connected by respective pins 44 and 46 to the support 20 and to the movable member 32, to be charged both by compression or by torsion. The rotation of movable member 32 moves the retaining teeth 48 from an abutting position on underlying protrusions 58 to void areas 64 allowing teeth 48 to come under the protrusions 58. Once the retaining teeth 48 crossed the void areas 64, the movable member 32, pushed by the spring 40 is snap-lowered by a tripping action and the torsion provided to the spring 40 carried the retaining teeth 48 under the protrusions 58, always through a tripping action, i.e. discharging the spring 40, returning the lowered position of said movable slider 32 and consequently, acting definitely on the contact means controlled thereby. The rotation of the movable member 32 cannot be greater than that allowed by the extension of the free areas 64, because of two limiting teeth 50 movable within limited slots 66, said rotation being also limited in reversed direction, when the retaining teeth 48, after, coming into the free areas 64, move to lie under the protrusions 58.

In summary, an actuation of the mushroom knob 12 or 13 compels the movable member 32 to rotate around its axis in a first time in clockwise direction to disengage the teeth 48 from the protrusions 58 and then, once the movable member 32 has been lowered, to carry retaining teeth 48, due to rotation in counterclockwise direction under the protrusions 58, providing the engagement of the movable member 32 in the lowered position.

It is to realize that the profiles 61 and 63 are preferably manufactured parallel to the axis of the stem 30 of the cam assembly 28, with a length quite lesser than the stroke length of the movable knobs 12 or 13, so that in case of breaking of the spring 40 the further stroke permitted to the movable member 32 allows to transmitt a push of the member, through abutting of the pin 26 against the rounded corner 65, ever advancing the movable member 32, permitting also in such a case the action of the planar disk pad 34 on the underlying contact means. Further, should the contacts of the underlying means be somehow hindered, such as by partial welding, the supplementary push of the pin 26 against the corner 65 will help in separating said contacts. The two embodiments of the present invention have also clearing means and mechanisms allowing to carry the push-button to a rest position, after it has been actuated, when the emergency situation have been overcome, or however when the alerting signals connected to such situations are no longer useful.

The recovering mechanisms are of two kinds chiefly depicted in the respective FIGS. 1 and 2, 6 and 7.

To recover the emergency push-button which, once pressed, maintains actuated the controlled contact means, it needs to return to rest position the movable member 32, by disengaging the retaining teeth 48 from the protrusions 58 in the internal bore 56 of the lower portion 54 of the tubular housing 14.

To this purpose, according to the first embodiment, it needs to rotate the mushroom knob 12, for example in clockwise direction, to trail, through the pin 26 and the stem 30, the movable member 32, disengaging the retaining teeth 48 from their position under the protrusions 58 to the position in front of the free areas 64. In making such a rotation, the spring 22, which was compressed, undergoes also a torsion owing to end pins 70 and 72 respectively coupled to the support 20 and to the seat 24 of the tubular housing 14. The retaining teeth 48, going under the free areas 64, are lifted by the spring 22 allowing the movable member 32 to come back in the rest position of FIG. 1. The spring 22, which was torsion charged because of the rotation of the mushroom knob 12, is now discharged returning the teeth 48 on the protrusions 58, thus preventing an unwanted falling down of the movable member 32.

Figure 6:
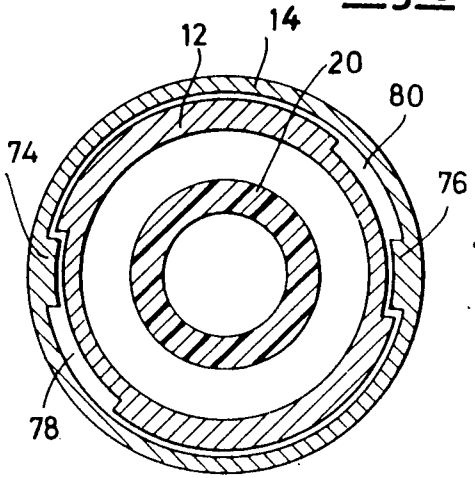
FIG. 6 is a cross-section view along line C—C of FIG. 1.

The rotation of the mushroom knob 12 is possible because, as depicted in FIGS. 4 and 6, the tubular housing 14 is internally provided with two axial ribs 74 and 76 engaging two enlarged grooves 78 and 80 externally provided in the stem of the mushroom knob 12. In fact, when by grasping the mushroom knob 12 it is rotated in the clockwise direction, the enlarged grooves 78 and 80 formed in housing 14 permit the rotation, providing then through the action of the pins 18 and 26, the clearing of the retaining teeth 48 from the protrusions 58, the lifting of teeth 48 through the free areas 64 by release of the spring 22, which was axially compressed, and the coming back of the teeth 48 over the protrusions 58, by discharging of the torsion of spring 22 undergone during the recovery rotation of the mushroom knob 12.

According to another embodiment, the recovery is provided through rotation of cylinder lock 15 by key 17.

Figure 7:
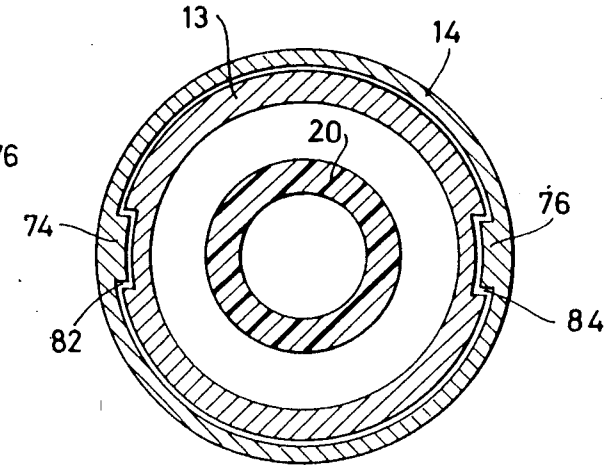
FIG. 7 a cross-section view along line D—D of FIG. 2.

In this case the mushroom knob 13 cannot rotate with respect to the tubular housing 14, because as depicted in FIG. 7, the stem is provided with grooves 82 and 84 substantially following in size the ribs 74 and 76 inside the tubular housing 14. However, since the cylinder lock 15 is turnable with respect to the mushroom knob 13 and the lock is connected to the support 20 through the pin 18, the recovery rotation of support 20 and the consequent torsion of the spring 22 are secured by cylinder lock 15, which of course, can be turned just when the key 17 is inserted in the lock 15.

The rotation of the cylinder lock 15 allows a recovery of the movable member 32 in a way completely similar to that of the movable member 32 of FIG. 1 embodiment.

What has been hereabove specified depicted two not limiting embodiments of the present invention and it will be obvious to those skilled in the art to devise fully or partially equivalent features comprised in the coverage of the present application.

For example, the springs 22 and 40 provided with pins assuring their torsion, could be replaced with two respective springs, separately assuring axial and rotating, movements, or the springs could be replaced by sleeves **22*a*, 401 of elastomeric materials (as shown in FIG. 1*a***), provided with pin fasteners, or the like, to allow the axial and rotating movements.

We claim:

1. An emergency push-button with a safe actuation, comprising a fixed housing; a knob movable along an axis thereof upon actuation of the knob; retaining and releasing means positioned in said housing for said axially movable knob; a slider support rigidly connected to said knob and being spring-biased in said housing, said retaining and releasing means including a member movable in an axial direction of said knob by axial sliding of said slider support as said knob is actuated and being adapted to rotate about an axis parallel to a direction of actuation of said knob, said retaining and releasing means further including a plurality of retaining members provided on said movable member, and a plurality of protrusions provided on said housing, said retaining members cooperating with said protrusions as said movable member rotates such that said retaining members move in a direction of rotation of said movable member and subsequently abut under respective protrusions, said retaining members being unlatcheable from said protrusions through a subsequent rotation of said movable member and a movement of said retaining members around said protrusions; and means effecting a rotational movement of said movable member as said movable member is axially moved, said movable member including a stem extending into said slider support; said rotational movement effecting means including cam means formed within said stem, and a pin provided in said slider support and movable therealong and extending transversely of said axis, said pin being engaged in and cooperating with said cam means to cause rotation and a tripping action of said movable member resulting in engagement of said retaining members with or disengagement of said retaining members from said protrusions, respectively.

2. The emergency push-button according to claim 1, wherein said cam means include a recess formed in said stem, said recess being provided with at least two shaped surfaces of which one surface is parallel to said axis of the knob and another surface is sloping with respect to said axis.

3. The emergency push-button according to claim 2, wherein said recess is provided with two pairs of opposing shaped surfaces of which a first pair is positioned parallel to the axis of movement of the knob and a second pair has surfaces sloping with respect to said axis.

4. The emergency push-button according to claim 3, wherein said movable member is connected to said knob by resilient means which are loaded in a first direction parallel to the axis of said knob and in a second direction perpendicular to said axis of said knob to allow a first rotary movement of said movable member in order to permit said retaining members of the movable member to snap on said protrusions as said retaining members move around said protrusions or disengage from said protrusions, an axial advancing movement of said retaining members beyond said protrusions, and a second rotary movement in a direction opposite to that of said first rotary movement to ensure engagement of said retaining members of said movable member with said protrusions.

5. The emergency push-button according to claim 3, wherein said retaining members are retaining teeth.

6. The emergency push-button according to claim 5, wherein said resilient means comprise a first axially extending spring acting on said slider support and which is charged by compression to allow advancing of said movable member with respect to said protrusions, and a second spring acting on said movable member and which is charged to force said retaining teeth of said movable member to move around said protrusions and then is discharged to carry said retaining teeth under said protrusions.

7. The emergency push-button according to claim 5, wherein said resilient means comprise just one spring acting on said movable member and strainable in an axial direction by compression and in a rotary direction by torsion in order to allow said retaining teeth to move around said protrusions to axially advance said teeth beyond said protrusions and to move said retaining teeth back under said protrusions.

8. The emergency push-button according to claim 5, wherein said resilient means comprise at least one elastomeric sleeve acting on said movable member and strainable by compression and by rotation in order to force said retaining teeth to move around said protrusions to axially advance said teeth and to move said teeth back under said protrusions.

9. The emergency push-button according to claim 5, wherein said movable member has a planar disk at a lower end thereof and wherein said cam means has an axial length smaller than a stroke permitted to said movable knob so that in case of breaking of said resilient means a deeper stroke of said movable knob into said housing is always provided to push forward said movable member always ensuring the movement thereof, even if a movement of said planar disk is hindered by damages to controlled means.

10. The emergency push-button according to claim 9, wherein said resilient means comprise a pair of springs of which one operates by an axial movement of said knob and another operates by rotation of said knob.

11. The emergency push-button according to claim 9, wherein said resilient means comprise just one spring constructed to be strainable by axial compression due to actuation of the push-button, to remain compressed by engagement of said retaining teeth under said protrusions and to be subsequently strained by torsion caused by a rotation of said knob to release said retaining teeth from said protrusions.

12. The emergency push-button according to claim 9, wherein said resilient means is constructed to remain charged after said knob has been held lowered by said movable member which in turn has been held by said retaining teeth under said protrusions, said resilient means being further actuatable by rotation of said knob in order to release said retaining teeth from said protrusions and to bring said knob back to a rest position thereof.

13. The emergency push-button according to claim 12, and further comprising a cylinder lock connected to said slider support and adapted to place the push-button to a recovered position after actuation, said lock being turnable by a key.

* * * * *